US008627813B1

(12) United States Patent
Close

(10) Patent No.: US 8,627,813 B1
(45) Date of Patent: Jan. 14, 2014

(54) CARRYING HANDLE FOR COMPOUND ARCHERY BOW

(76) Inventor: Gregory S. Close, Essexville, MI (US)

( * ) Notice: Subject to any disclaimer, the term of this patent is extended or adjusted under 35 U.S.C. 154(b) by 256 days.

(21) Appl. No.: 12/758,030

(22) Filed: Apr. 12, 2010

(51) Int. Cl.
*F41B 5/00* (2006.01)

(52) U.S. Cl.
USPC ..... 124/88; 124/89

(58) Field of Classification Search
USPC ..... 124/86, 88, 89
See application file for complete search history.

(56) References Cited

U.S. PATENT DOCUMENTS 5,333,595 A * 8/1994 Heffron ..... 124/88
5,522,376 A * 6/1996 Collinsworth ..... 124/86
5,531,211 A * 7/1996 Wilfong, Jr. ..... 124/86
5,934,266 A * 8/1999 Martin et al. ..... 124/88
5,992,403 A * 11/1999 Slates ..... 124/89

* cited by examiner

*Primary Examiner* — John Ricci
(74) *Attorney, Agent, or Firm* — Robert L. Farris; Farris Law, P.C.

(57) ABSTRACT

A carrying handle for a compound archery bow includes an anchor portion, an intermediate portion, and a hand engaging portion. These portions are integral with each other and form a one piece handle. The handle lower end is on the anchor portion. The handle free end is on the hand engaging portion. The anchor portion includes a riser engaging surface and a bore with a stabilizer bore axis. A bolt passes through the bore and in to a threaded stabilizer bore in the riser. The intermediate portion sets the distance between a bow hand grip and the hand engaging portion. The hand engaging portion is directly forward of the hand grip on the riser. The hand engaging portion includes a hand engaging surface. A threaded bore with a forwardly facing open end is provided in the engaging portion. A stabilizer is received in the threaded bore.

14 Claims, 5 Drawing Sheets

CARRYING HANDLE FOR COMPOUND ARCHERY BOW

TECHNICAL FIELD

The invention is in a compound archery bow and more particularly in a carrying handle for a compound bow.

BACKGROUND OF THE INVENTION

Compound bows have a rigid riser, an upper limb, a lower limb, pulley members journaled on the limb outer ends, and a bow string assembly. A hand grip is mounted on the rigid riser. The hand grip is shaped to be held by an archer with the bow string between the hand grip and the archer's body. Archers have not found the hand grip to be suitable for carrying compound bows between hunting positions. Bows can be carried by the bow string. After a relative short period of time the bow string applies pressure to a persons hand and fingers and reduces blood circulation to finger tips.

A number of carrying slings have been tried. Some of the slings have to be removed before the bow can be employed to launch an arrow. Other slings are loose and can interfere with bow sights or arrow rests.

Compound bows have been provided with a carrying handle to the rear of the hand grip and integral with the riser. The hand grip could contact a person's arm when holding the bow by the carrying handle. Another compound bow has a second hand grip that is perpendicular to the first hand grip. Neither hand grip would be suitable for a carrying handle.

SUMMARY OF THE INVENTION

A compound bow includes a riser with a hand grip, a riser upper end and a lower end. A threaded stabilizer bore is provided in the riser. The open end of the threaded stabilizer bore faces forwardly in the direction of travel of launched arrows. An upper limb is fixed to the upper end of the riser by an upper fastener. A lower limb is fixed to the lower end of the riser by a lower fastener.

A carrying handle for the compound bow includes an anchor portion with an anchor end. A riser engaging surface is provided on the anchor portion. A bore with a stabilizer bore axis passes through the anchor portion. A threaded fastener passes through the bore with a stabilizer bore axis and into the threaded stabilizer bore in the riser. The riser engaging surface is urged rearward toward the riser by the threaded fastener.

An intermediate portion of the carrying handle is integral with the anchor portion. The intermediate portion extends upwardly and forwardly a selected distance from the riser engaging surface on the anchor portion. The length and shape of the intermediate portion of the carrying handle is selected to position a hand engaging portion in a selected position relative to the hand grip on the riser.

A hand engaging portion, of the carrying handle, is integral with the intermediate portion and extends to a handle upper free end. At least four arcuate recesses in the hand engaging portion of the carrying handle face rearwardly toward the hand grip. The arcuate recesses are finger receiving recesses. A threaded bore in the carrying handle is positioned away from the bore passing through the anchor portion. The threaded bore in the carrying handle is parallel to the stabilizer bore axis. The threaded bore in the hand engaging portion has an open end that faces away from the arcuate recesses. The threaded bore in the carrying handle is vertically poisoned between two of the four arcuate recesses closest to the handle free end.

A stabilizer assembly includes a stabilizer and a threaded stabilizer stud. The threaded stabilizer stud is received in the threaded bore in the carrying handle. The hand engaging portion of the carrying handle is laterally centered on the hand grip on the rigid riser.

BRIEF DESCRIPTION OF DRAWINGS

The presently preferred embodiment of the invention is disclosed in the following description and in the following drawings, wherein.

DETAILED DESCRIPTION OF THE PREFERRED EMBODIMENTS

Figure 1:
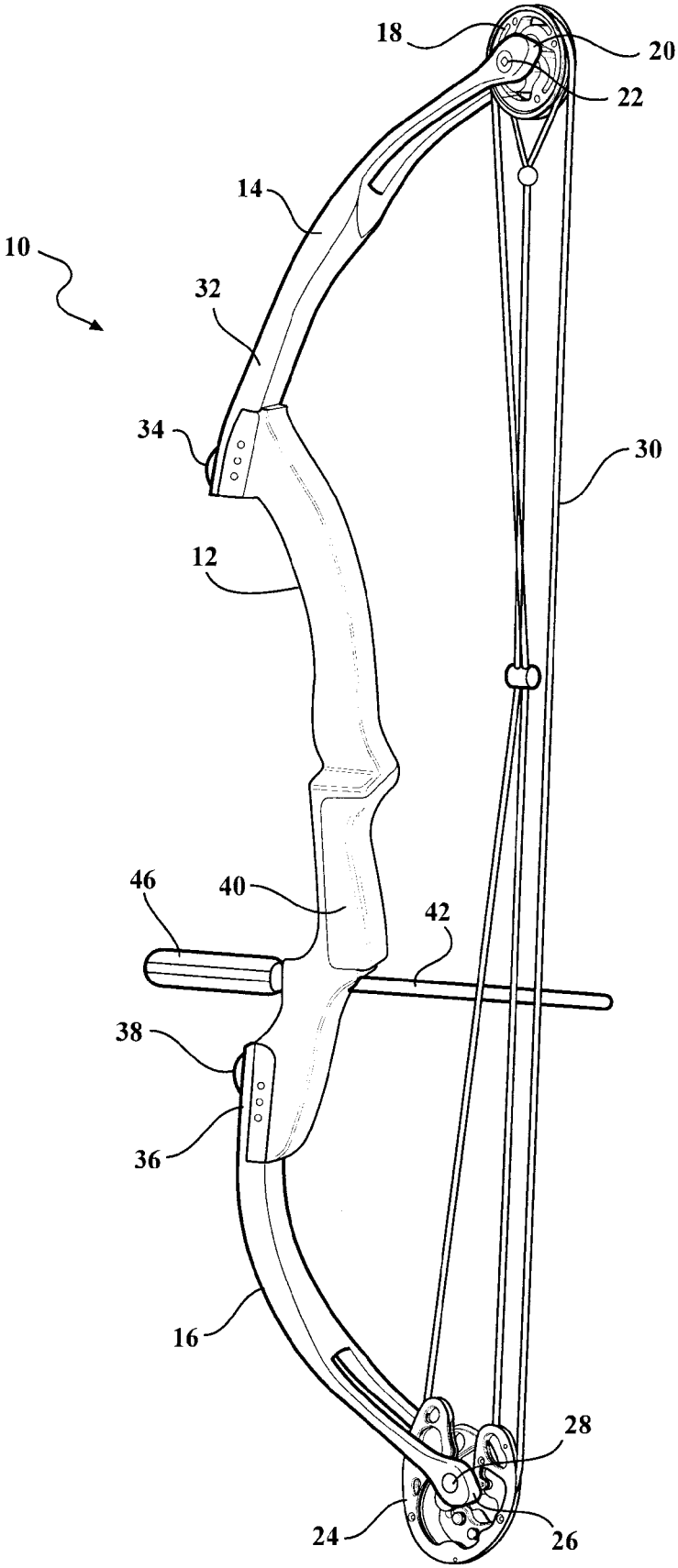
FIG. 1 is a perspective view of a compound bow with a stabilizer attached to a rigid riser.

Compound bows 10 include a rigid riser 12, and upper limb 14 and a lower limb 16. A pulley member 18 is journaled on an outer end 20 of the upper limb 14 by a shaft 22. A pulley member 24 is journaled on an outer end 26 of the lower limb 16 by a shaft 28. A bow string assembly 30 is connected to the pulley members 18 and 24.

The upper limb 14 and the lower limb 16 are springs. The inner end 32 of the upper limb 14 is attached to the riser 12 by a fastener 34. The inner end 36 of the lower limb 16 is attached to the riser 12 by a fastener 38. Limbs 14 and 16 are constructed from a number of different materials including metals and composite materials. The composite materials may include plastics reinforced by fibers such as a carbon. The fasteners 34 and 38 employed on compound bows 10 very substantially from one bow to another. Some fasteners 34 and 38 create a rigid connection between the inner ends 32 and 36 of the limbs 14 and 16 and the riser 12. Other fasteners 34 and 38 permit some movement between the inner ends 32 and 36 of the limbs 14 and 16 and the riser 12.

The pulley members 18 and 24 very substantially from one bow 10 to another. The bow string assemblies 30 also very from one bow 10 to another to accommodate the pulley members 18 and 24 that are employed.

The riser 12 employed in compound bows 10 are generally metal. The metal used is may be an aluminum alloy to reduce weight and provide rigidity. However, other metals can be used. Composite materials that provide sufficient rigidity can also be employed.

Risers 12 are commercially available in a variety of shapes. Although there are substantial differences in the risers 12 that are in use today, there are also common features. All of the risers 12 have a hand grip 40. Limb mounting surfaces are also required. A cable guide 42 is usually provided. A threaded stabilizer bore 44 is generally provided in risers 12. However, the use of a stabilizer 46 is optional. Many risers 12 have mounting members for sights and arrow rests.

Figure 2:
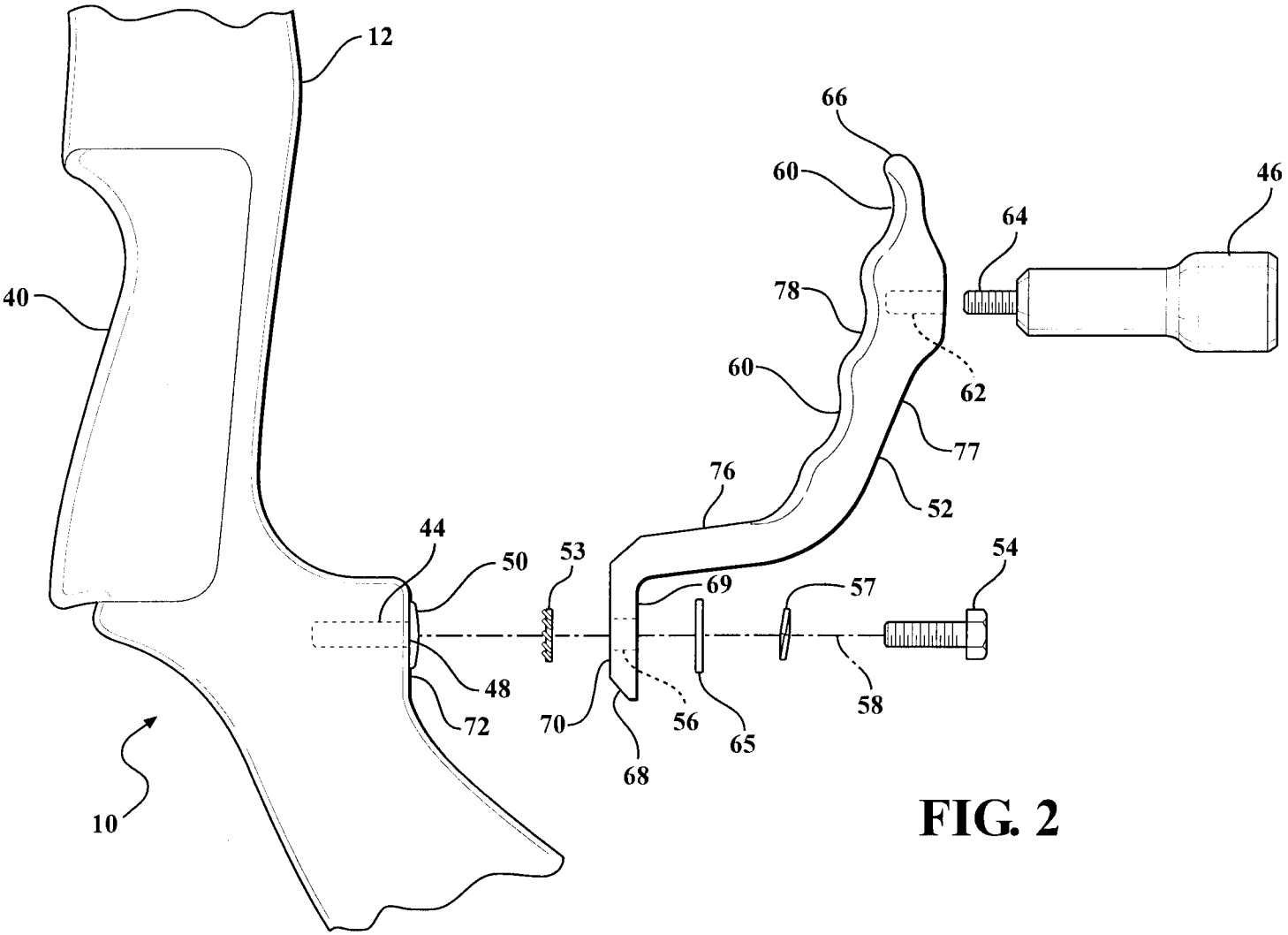
FIG. 2 is an enlarged expanded view of a riser, a carrying handle and a stabilizer, with parts broken away.

The riser 12 shown in FIG. 2 includes a hand grip 40. A stabilizer bore 44 is provided in the riser 12. The stabilizer bore 44 has a stabilizer bore axis 58 that is generally horizontal. An open end 48 of the stabilizer bore 44 faces down range and in the direction of any arrows that are launched by the compound bow 10. The stabilizer bore 44 is threaded in some risers 12. The bore 44 is a smooth bore in other risers 12. The smooth bore 44 receives a threaded bore plug 50. A plug 50 having threads, that are compatible with the stabilizer or a bolt 54 that is to be used, is pressed into the smooth bore 44 and becomes an integral part of the riser 12.

A carrying handle 52 is a clamped to the riser 12 by a bolt 54. The bolt 54 passes through a bore 56 through the lower end of the handle 52. The bore 56 has a stabilizer bore axis 58 shown in FIG. 2. A lock washer 53 can be provided between the handle 52 and the riser 12 or plug 50, if desired or needed. A flat washer 55 and a lock washer 57 may also be provided between the head of the bolt 54 and the bore 56. The carrying handle 52 is held in a position that is forward from the hand grip 40 and generally in vertical alignment with the hand grip. Four arcuate recesses 60 are provided in the handle 52 for the fingers of a hunter. These arcuate recesses 60 face toward the hand grip 40. The handle 52 is spaced forward from the hand grip 40 to eliminate contact with fingers extending forward from the hand grip 40.

Some hunters elect to employ a stabilizer 46 in combination with the handle 52. A threaded bore 62 in the carrying handle 52, adjacent to the handle upper free end 66, receives the threaded stud 64 on a stabilizer 46. The threaded bore 62 is between the upper finger recess 60 and the second finger recess 60 from the handle free end 66. If desired, the bolt 54 could be replaced by the stabilizer 46 and a threaded stud 64 with the correct length.

Figure 4:
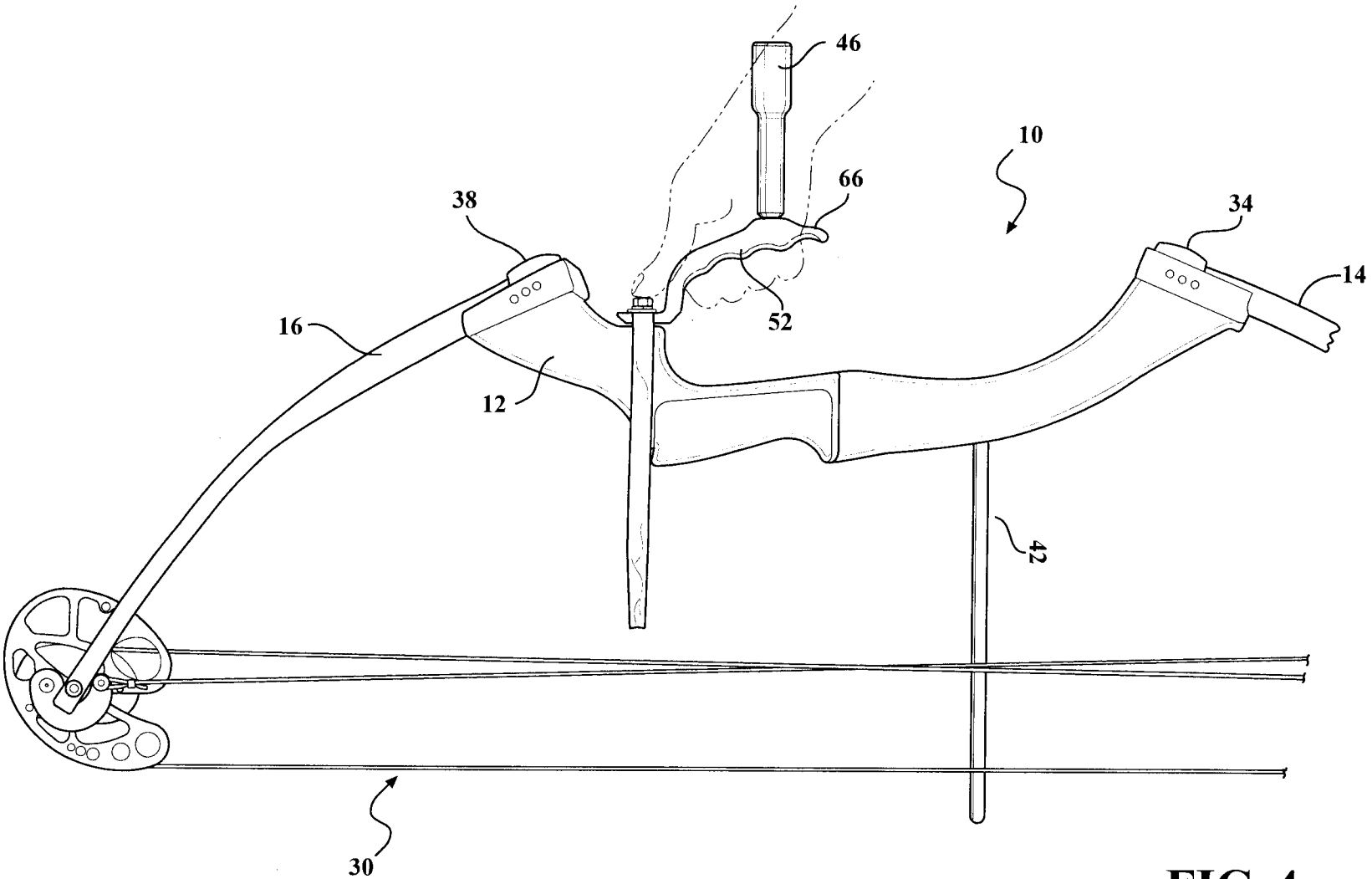
FIG. 4 is a side elevational view of the carrying handle and a stabilizer held by an archer's hand, with the archer's right thumb facing the lower limb, with parts broken away.
Figure 5:
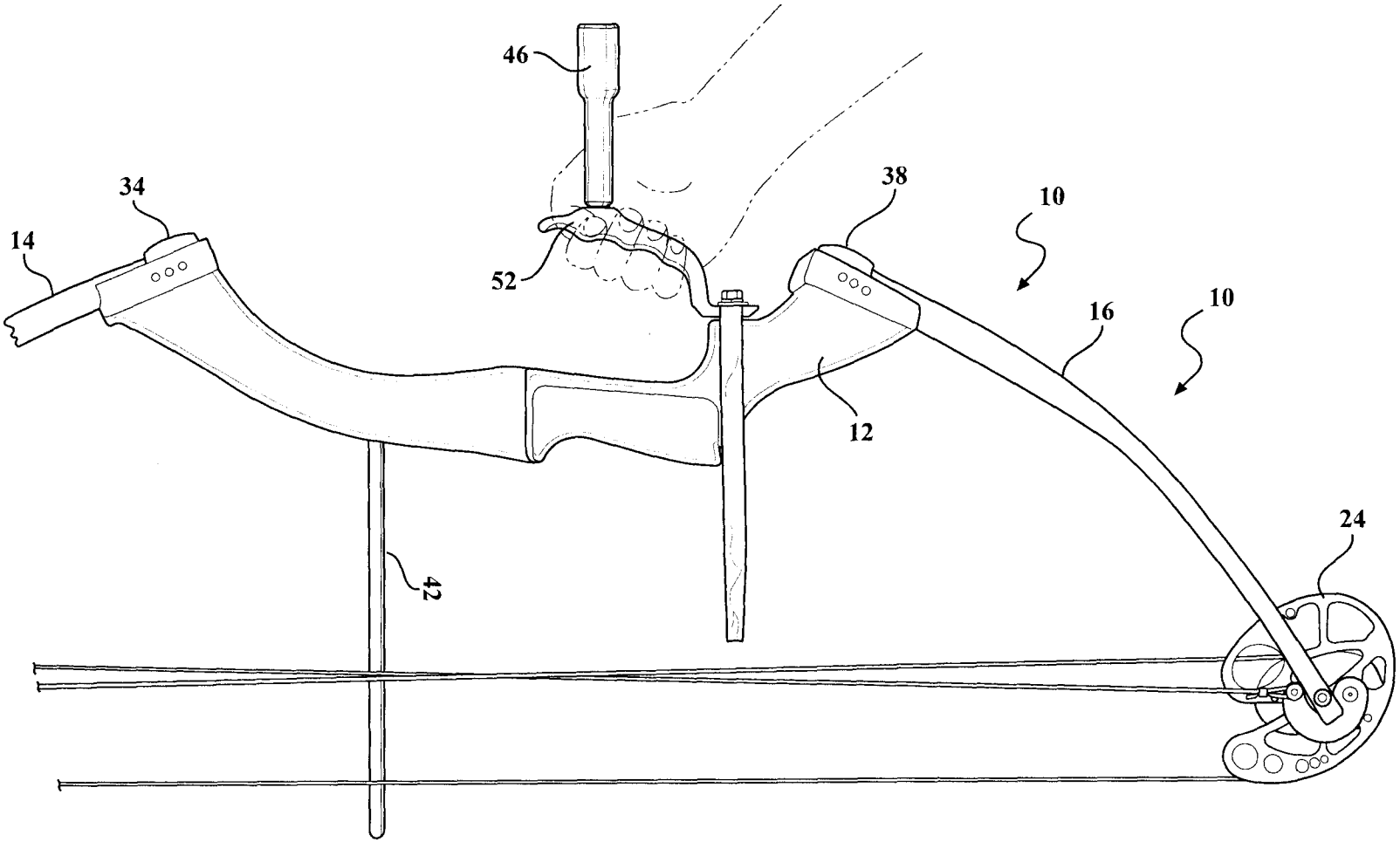
FIG. 5 is a side elevational view of the carrying handle and a stabilizer held by an archer's hand, with the archer's right thumb facing the upper limb, with parts broken away.

The compound bow 10 can be carried by the right hand with the lower riser 16 to the front as shown in FIG. 4. The compound bow 10 can also be carried in the right hand with the upper riser 14 to the front as shown in FIG. 5. The compound bow 10 can also be carried in the left hand in either direction. With a stabilizer 46 attached to the threaded bore 62 in the handle 52, the stabilizer assists a hunter in rotating the bow about an axis parallel to the bow string 30. Rotation about an axis parallel to the bow string may be needed to avoid an obstruction.

The carrying handle 52 also has an anchor end 68 opposite the handle free end 66. The anchor end 68 includes a bore 56 for passage of the bolt 54 or other handle attaching member. The bore 56 has stabilizer bore axis 58 as shown in FIG. 2. A riser engaging surface 70 on the handle 52 faces toward the riser 12 and is seated on a riser surface 72 of the riser 12 or the bore plug 50 adjacent to the open end 48 of the threaded stabilizer bore 44. The surface 72 of the riser 12 is nearly perpendicular to the axis 58 of the threaded stabilizer bore 44 in most compound bows 10. The stabilizer bore axis 58 is generally horizontal and the open end 48 of the bore 44 faces down range toward a target during employment of the compound bow 10.

Figure 3:
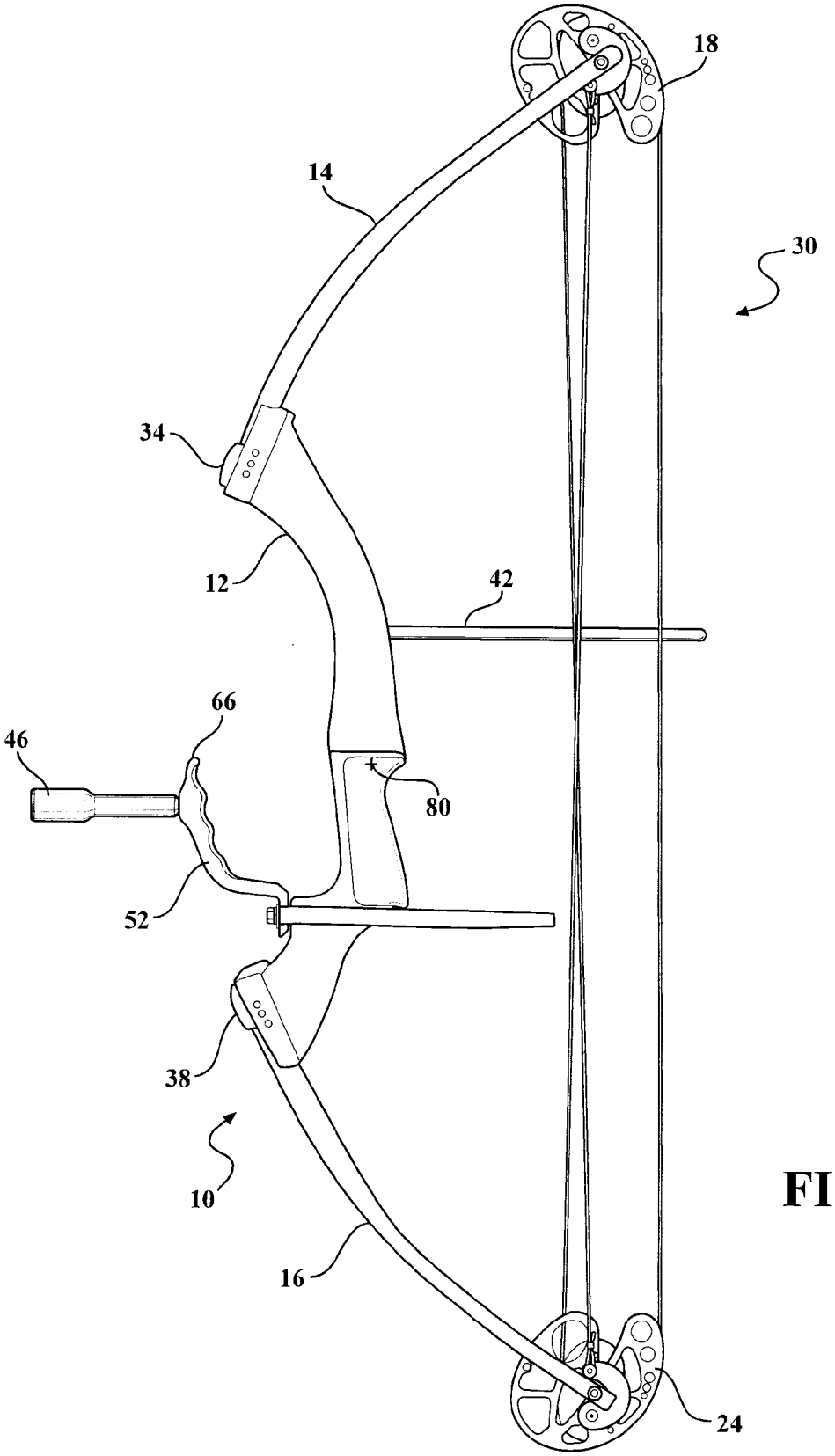
FIG. 3 is a side elevational view of a compound bow with the carrying handle and a stabilizer attached to the riser.

Risers 12 vary in size and shape from one manufacturer to another. One difference between rigid risers 12 is the fore and aft distance between the surface 72, of the riser 12 or the bore plug 50 adjacent to the open end 48 of the threaded stabilizer bore 44, and the hand grip 40. There needs to be sufficient distance between the hand grip 40 and the carrying handle 52 to insure that the handle does not interfere with an archer's fingers when employing the compound bow 10. In addition to the horizontal distance between the hand grip 40 and the surface 72 of the riser 12, the handle 52 should accommodate the hand size of the archer using the compound bow 10. Both of these factors are accommodated by providing handles 52 with different length intermediate portions 76 between the anchor portion 69 with the riser engaging surface 70 and the hand engaging surface 78 with arcuate recesses 60 that receive an archer's fingers. The length of the intermediate portion 76 shown in FIGS. 2 and 3 is elongated. The length of the intermediate portion 76 shown in FIGS. 4 and 5 is shortened. Handles 52 with an intermediate portion 76 having a length that is between that of the two lengths disclosed in the drawing Figures can also be provided.

The position of a center of gravity 80 of a compound bow 10 varies somewhat from one bow manufacturer to another. However, most manufacturers design their bows 10 to have a center of gravity 80 near the hand grip 40 and an arrow rest. Reference number 80 in FIG. 3 identifies a possible location of a center of gravity. During use of the carrying handle 52, the hand engaging portion 77 with hand engaging surface 78 is above the center of gravity 80. Forces on the carrying handle 52 are primarily vertically downward forces due to the weight of the compound bow 10 and the location of the hand engaging portion 77. The threaded bore 62 in the carrying handle 52 is preferably parallel to the stabilizer bore axis 58 of bore 56. The stabilizer 46, when mounted in the threaded bore 62, assists a bowman in controlling and changing the orientation of the compound bow 10 when moving across areas with obstacles. The stabilizer 46 also holds a bowman's hand in the desired position on the hand engaging portion 77.

The handle 52 is particularly useful in rough train when using a walking stick in the other hand.

I claim:

1. A carrying handle for a compound bow including a riser with a hand grip, a threaded stabilizer bore with an open end facing forwardly in the direction of travel of launched arrows, an upper limb fixed to one end of the riser, a lower limb fixed to another end of the riser opposite the one end of the riser and wherein the carrying handle comprises:

an anchor portion with an anchor end, a riser engaging surface, a bore with a stabilizer bore axis passing through the anchor portion;

an intermediate portion, of the carrying handle, integral with the anchor portion and extending away from the riser engaging surface on the anchor portion;

a hand engaging portion of the carrying handle integral with the intermediate portion and extending to a handle free end, a hand engaging surface on the hand engaging portion, the hand engaging surface facing substantially in the same direction as the riser engaging surface, a threaded bore in the carrying handle parallel to the stabilizer bore axis, positioned away from the bore passing through the anchor portion and wherein the threaded bore in the hand engaging portion has an open end that faces away from the riser engaging surface on the anchor portion; and wherein the hand engaging surface includes a plurality of arcuate recesses.

2. A carrying handle for the compound bow, as set forth in claim 1, wherein each of the plurality of arcuate recesses is a finger receiving recess.

3. A carrying handle for the compound bow, as set forth in claim 2, wherein the plurality of arcuate recesses includes four arcuate recesses.

4. A carrying handle for the compound bow, as set forth in claim 1, wherein one of the plurality of arcuate recesses is between the handle free end and the threaded bore in the carrying handle.

5. A carrying handle for the compound bow, as set forth in claim 1, wherein the threaded bore in the carrying handle receives a stabilizer.

6. A carrying handle for a compound bow including a riser with a hand grip, a threaded stabilizer bore with an open end facing forwardly in the direction of travel of launched arrows, an upper limb fixed to one end of the riser, a lower limb fixed to another end of the riser opposite the one end of the riser and wherein the carrying handle comprises:

an anchor portion with an anchor end, a riser engaging surface, a bore with a stabilizer bore axis passing through the anchor portion and a threaded fastener that passes through the bore, into the threaded stabilizer bore and urges the riser engaging surface rearwardly toward the riser;

an intermediate portion, of the carrying handle, integral with the anchor portion and extending upwardly and forwardly away from the riser engaging surface on the anchor portion; and a hand engaging portion of the carrying handle integral with the intermediate portion and extending to a handle free end, a hand engaging surface on the hand engaging portion, a plurality of arcuate recesses in the hand engaging surface facing in substantially the same direction as the riser engaging surface, a threaded bore in the carrying handle positioned away from the bore passing through the anchor end and wherein the threaded bore in the hand engaging portion has an open end that faces away from the plurality of arcuate recesses.

7. A carrying handle for the compound bow, as set forth in claim 6, wherein each of the plurality of arcuate recesses in the hand engaging surface is a finger receiving recess.

8. A carrying handle for a compound bow, as set forth in claim 7, wherein the plurality of arcuate recesses includes four arcuate recesses.

9. A carrying handle for the compound bow, as set forth in claim 6, wherein the threaded bore in the hand engaging portion is between two of the plurality of arcuate recesses.

10. A carrying handle, for the compound bow, as set forth in claim 6, including a stabilizer with a threaded stud and the threaded stud is received in the threaded bore in the carrying handle.

11. A carrying handle for a compound bow including a riser with a hand grip, a threaded stabilizer bore with an open end facing forwardly in the direction of travel of launched arrows, an upper limb fixed to an upper end of the riser by an upper fastener, a lower limb fixed to a lower end of the riser by a lower fastener and wherein the carrying handle comprises:

an anchor portion with an anchor end, a riser engaging surface, a bore with a stabilizer bore axis passing through the anchor portion and a threaded fastener passing through the bore with a stabilizer bore axis, into the threaded stabilizer bore and urges the riser engaging surface rearwardly toward the riser:

an intermediate portion, of the carrying handle, integral with the anchor portion and extending upwardly and forwardly a selected distance from the riser engaging surface on the anchor portion;

a hand engaging portion of the carrying handle integral with the intermediate portion and extending to a handle free end, a hand engaging surface on the hand engaging portion, at least four arcuate recesses in the hand engaging surface facing rearwardly toward the hand grip and wherein the arcuate recesses are finger receiving recesses, a threaded bore in the hand engaging portions of the carrying handle positioned away from the bore passing through the anchor portion and wherein the threaded bore in the hand engaging portion has an open end that faces forwardly and away from the plurality of arcuate recesses, the threaded bore in the carrying handle is vertically positioned between two of the at least four arcuate recesses closest to the handle free end; and a stabilizer assembly including a stabilizer and a thread stabilizer stud received in the threaded bore in the carrying handle.

12. A carrying handle for a compound bow, as set forth in claim 11, wherein the intermediate portion of the carrying handle has a length and shape that positions the hand engaging portion in a selected position relative to the hand grip on the riser.

13. A carrying handle for a compound bow, as set forth in claim 11, wherein the threaded bore in the carrying handle is parallel to the stabilizer bore axis of the bore passing through the anchor portion.

14. A carrying handle for a compound bow, as set forth in claim 11 wherein the riser is rigid.

* * * * *